US007485080B1

(12) United States Patent
Chuang et al.

(10) Patent No.: US 7,485,080 B1
(45) Date of Patent: Feb. 3, 2009

(54) STATIONARY EXERCISER

(76) Inventors: Jin Chen Chuang, No. 17, Lane 301, Nanyang Road, Fong Yuan, Taichung Hsien (TW) 42083; Lung Fei Chuang, No. 17, Lane 301, Nanyang Road, Fong Yuan, Taichung Hsien (TW) 42083

( * ) Notice: Subject to any disclaimer, the term of this patent is extended or adjusted under 35 U.S.C. 154(b) by 0 days.

(21) Appl. No.: 11/901,564

(22) Filed: Sep. 18, 2007

(51) Int. Cl.
*A63B 26/00* (2006.01)

(52) U.S. Cl. ..... 482/142; 482/148

(58) Field of Classification Search ..... 482/51–52, 482/63, 142, 148
See application file for complete search history.

(56) References Cited

U.S. PATENT DOCUMENTS

| | | | | |
|---|---|---|---|---|
| 3,758,107 | A * | 9/1973 | Potgieter | 482/63 |
| 4,712,790 | A | 12/1987 | Szymski | 272/73 |
| 4,773,399 | A | 9/1988 | Richardson | 128/25 R |
| 4,842,269 | A * | 6/1989 | Huang | 482/62 |
| 5,044,627 | A | 9/1991 | Huang | 272/73 |
| 5,050,865 | A * | 9/1991 | Augspurger et al. | 482/2 |
| 5,527,250 | A * | 6/1996 | Chen | 482/96 |
| 6,485,395 | B1 * | 11/2002 | Stearns et al. | 482/57 |
| 6,740,010 | B2 * | 5/2004 | Sze | 482/63 |
| 6,910,991 | B2 * | 6/2005 | Matsumoto | 482/8 |
| 6,913,560 | B2 * | 7/2005 | Ryan et al. | 482/51 |

* cited by examiner

*Primary Examiner*—Lori Amerson
(74) *Attorney, Agent, or Firm*—Charles E. Baxley

(57) ABSTRACT

A stationary exerciser includes an upright support for supporting a spindle and a shaft, two levers having an upper portion pivotally attached to the upright support with the shaft, two cranks rotatably attached to the upright support with the spindle and each having a pivot rod, and two foot supports each having a rear portion pivotally coupled to the lever and a middle portion pivotally coupled to the pivot rod of the crank, and a foot pedal attached to the front portion and moveable elliptically relative to the upright support for being stepped or actuated by the user to move along an elliptical moving path different from the circular cycling moving path of that of the pedaling or cycling exercisers.

8 Claims, 6 Drawing Sheets

STATIONARY EXERCISER

BACKGROUND OF THE INVENTION

1. Field of the Invention

The present invention relates to a stationary exerciser, and more particularly to a stationary exerciser including a pair of foot supports or foot pedals for being stepped or operated or actuated similar to the pedaling or cycling exercisers, but along an elliptical moving path different from the typical circular cycling moving path of that of the typical pedaling or cycling exercisers.

2. Description of the Prior Art

Typical stationary exercisers comprise a pair of foot supports or foot pedals rotatably attached to a spindle of a cycle frame with a pair of cranks and arranged for allowing the foot supports or foot pedals to be stepped or operated or actuated by the feet of the users in the typical circular cycling moving path.

For example, U.S. Pat. No. 4,712,790 to Szymski, and U.S. Pat. No. 4,773,399 to Richardson disclose two of the typical cycle exercisers each also comprising a pair of foot supports or foot pedals rotatably attached to a spindle of a frame of an exerciser with a pair of cranks, and the foot supports or foot pedals may also be stepped or operated or actuated by the feet of the users in the typical circular cycling moving path, but may not be moved in the elliptical moving path.

U.S. Pat. No. 4,842,269 to Huang, and U.S. Pat. No. 5,044,627 to Huang disclose two further typical stationary exercisers or bikes each also comprising a pair of foot supports or foot pedals rotatably attached to a frame of an exerciser with an oval or elliptical track, and the foot supports or foot pedals may be stepped or operated or actuated by the feet of the users in the elliptical moving path.

However, it will be difficult to precisely form or manufacture the oval or elliptical track, and a number of rollers or wheels are further required to be provided to couple the foot supports or foot pedals to the oval or elliptical track and for allowing the foot supports or foot pedals to be smoothly moved relative to the oval or elliptical track, such that the manufacturing cost for the typical stationary exercisers or bikes will be greatly increased.

The present invention has arisen to mitigate and/or obviate the afore-described disadvantages of the conventional stationary exercisers.

SUMMARY OF THE INVENTION

The primary objective of the present invention is to provide a stationary exerciser including a pair of foot supports or foot pedals for being stepped or operated or actuated similar to the pedaling or cycling exercisers, but along an elliptical moving path different from the typical circular cycling moving path of that of the typical pedaling or cycling exercisers.

In accordance with one aspect of the invention, there is provided a stationary exerciser comprising a base, an upright support extended upwardly from a rear portion of the base for supporting a seat, a spindle and a shaft attached to the upright support, and the spindle being spaced from the shaft and located in front of the shaft, a pair of levers each including an upper portion pivotally attached to the upright support with the shaft for allowing the levers to swing relative to the upright support, and each including a lower portion, a pair of cranks rotatably attached to the upright support with the spindle for allowing the cranks to be rotated relative to the upright support, the cranks each including a pivot rod attached thereto, and a pair of foot supports each including a front portion, and each including a rear portion pivotally coupled to the lower portion of the lever for allowing the rear portion of the foot support to swing relative to the upright support, and each including a middle portion pivotally coupled to the pivot rod of the crank with a link for allowing the middle portions of the foot supports to be moved cyclically relative to the upright support by the cranks, and for allowing the front portions of the foot supports to be moved elliptically relative to the upright support, and the foot supports each including a foot pedal for being stepped by a user and for being moved elliptically relative to the upright support.

An arm is further provided and coupled between the crank and the lever for pivotally coupling the lever and the crank together. For example, the arm is coupled to a middle portion of the lever. The arm may be coupled to the pivot rod of the crank.

A resisting device may further be provided for resisting the spindle, and includes a rotary member attached to the spindle and rotated in concert with the spindle. A follower may further be provided and rotatably attached to the upright support with a pivot pin and coupled to the rotary member with a coupling device. A wheel may further be provided and rotatably attached to the upright support with an axle and coupled to the follower with a coupling device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
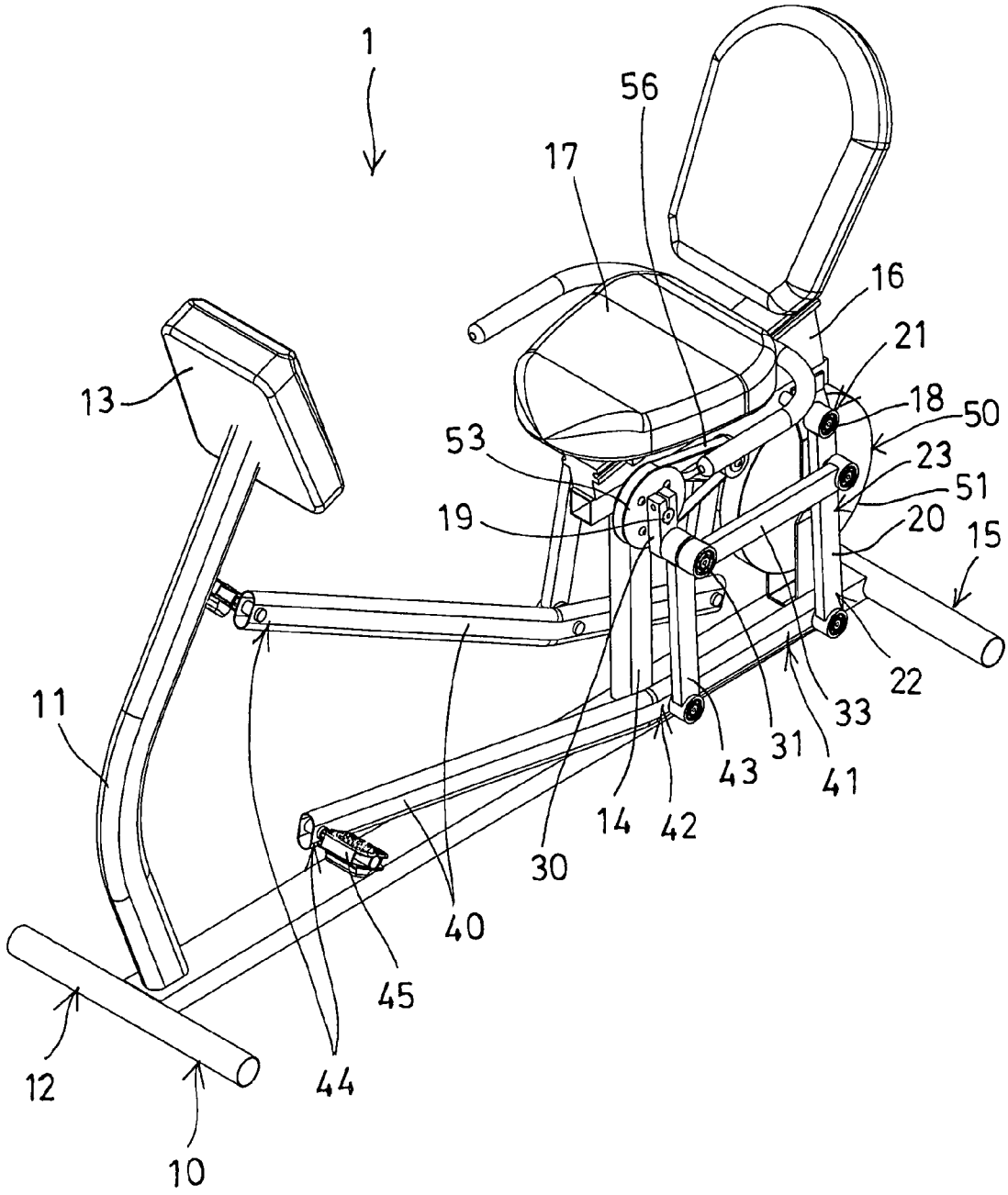
FIG. 1 is a front perspective view of a stationary exerciser in accordance with the present invention.
Figure 2:
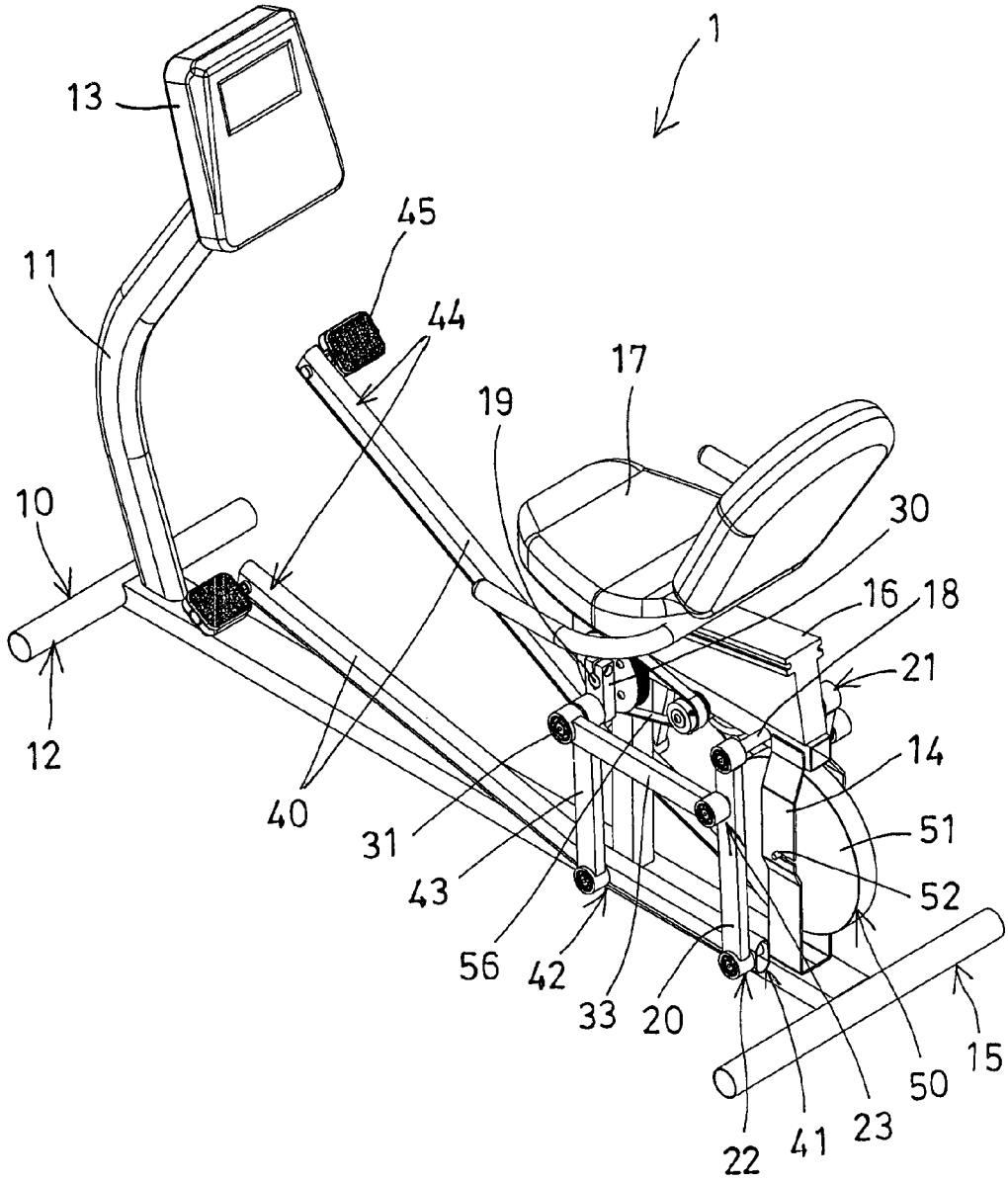
FIG. 2 is a rear perspective view of the stationary exerciser.

Referring to the drawings, and initially to FIGS. 1-5, a stationary exerciser in accordance with the present invention comprises a base 10, a post 11 extended upwardly from such as the front portion 12 of the base 10 for attaching or supporting such as a control panel or control device 13 or the like, and an upright support 14 extended upwardly from such as the rear portion 15 of the base 10 for attaching or supporting such as a track or rail 16, and a seat cushion or seat 17 slidably or adjustably attached to the rail 16 of the upright support 14 for suitably or adjustably supporting the user on the seat 17.

A pair of levers 20 each include an upper portion 21 pivotally or rotatably attached to the upright support 14 with a shaft 18 for allowing the levers 20 to be dependent or swung relative to the base 10 or the upright support 14, and a pair of cranks 30 rotatably attached to the upright support 14 with a spindle 19 for allowing the cranks 30 to be rotated relative to the base 10 or the upright support 14, the cranks 30 each include a pivot rod 31 attached to the outer or free end portion thereof and arranged for allowing the pivot rods 31 to be rotated cyclically relative to the base 10 or the upright support 14 around the spindle 19. The spindle 19 and the shaft 18 are attached to the upright support 14, and the spindle 19 is spaced from the shaft 18 and located in front of the shaft 18.

Figure 6:
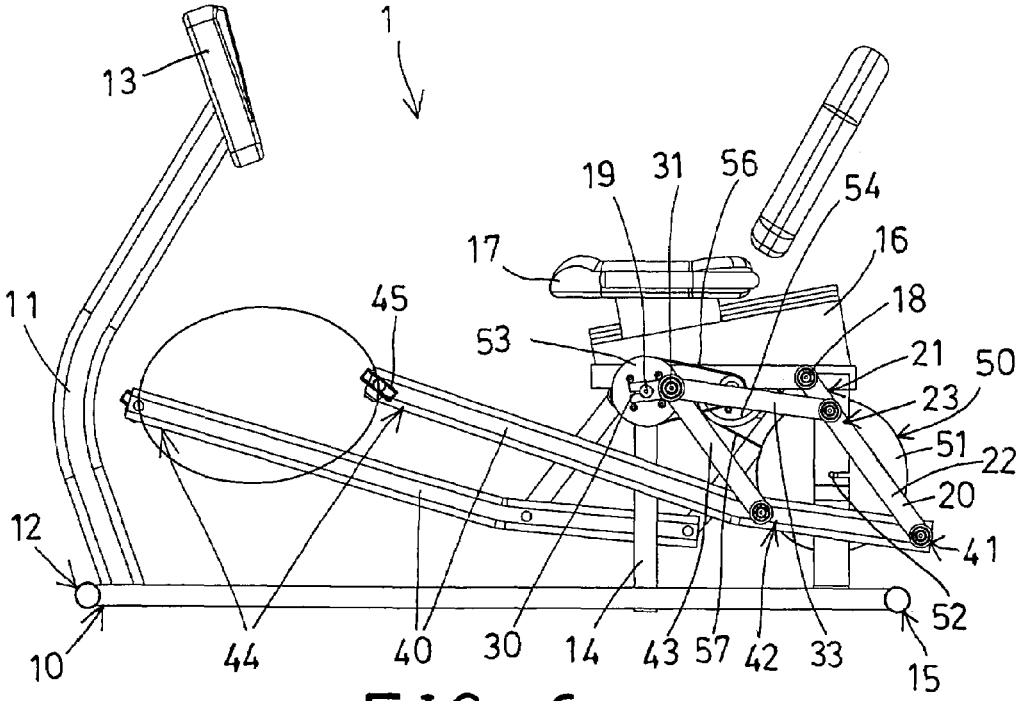
FIGS. 6, 7 are side plan schematic views similar to FIG. 3, illustrating the operation of the stationary exerciser.
Figure 7:
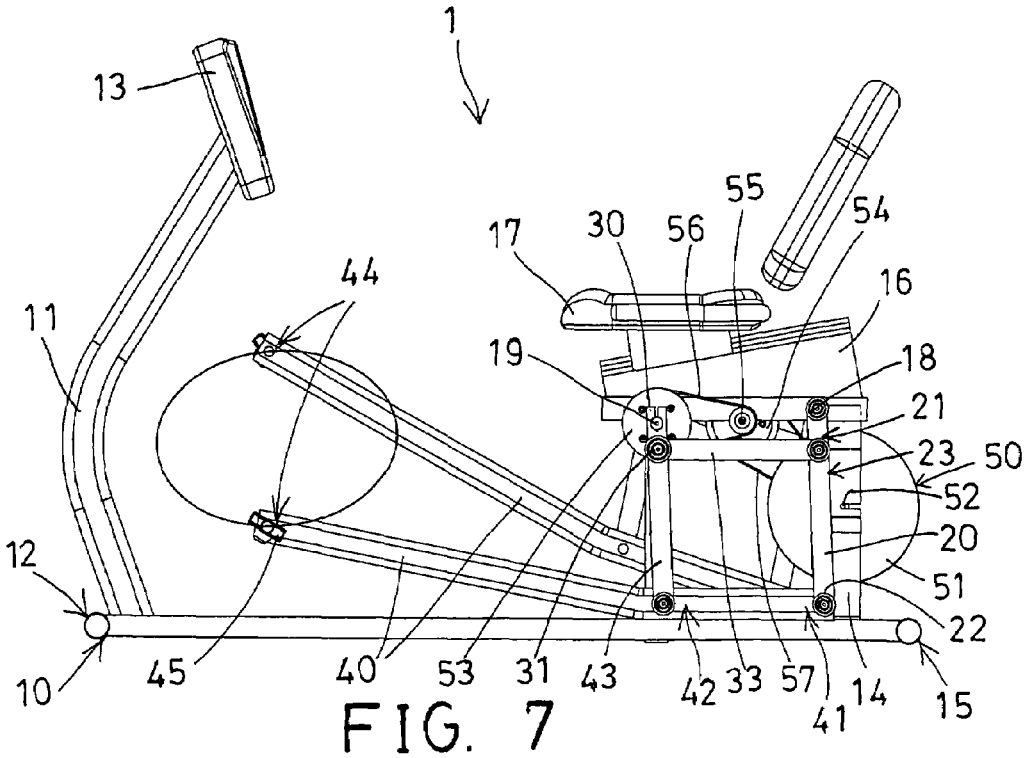

A pair of foot supports 40 each include a rear portion 41 pivotally or rotatably attached or coupled to the lower portion 22 of the levers 20 for allowing the rear portions 41 of the foot supports 40 to be dependent or swung relative to the base 10 or the upright support 14, and each include a middle portion 42 pivotally or rotatably attached or coupled to the pivot rods 31 of the cranks 30 with a link 43 respectively for allowing the middle portions 42 of the foot supports 40 to be moved cyclically relative to the base 10 or the upright support 14 by the cranks 30, and thus for allowing the front portions 44 of the foot supports 40 to be moved elliptically relative to the base 10 or the upright support 14 (FIGS. 6, 7).

A foot pedal 45 is further provided and attached to the front portion 44 of each of the foot supports 40 respectively for being engaged with or stepped by the feet of the users and for allowing the front portions 44 of the foot supports 40 to be stepped or operated or actuated by the feet of the users to move elliptically relative to the base 10 or the upright support 14. A pair of bars or arms 33 may further be provided and attached or coupled between the pivot rods 31 of the cranks 30 and the middle portions 23 of the levers 20 for suitably coupling the levers 20 and the cranks 30 and the foot supports 40 together and for determining the moving stroke of the foot supports 40. For example, the arms 33 may be selectively moved or adjusted along the levers 20 (not shown) to adjust or to determine the moving stroke of the foot supports 40.

Figure 3:
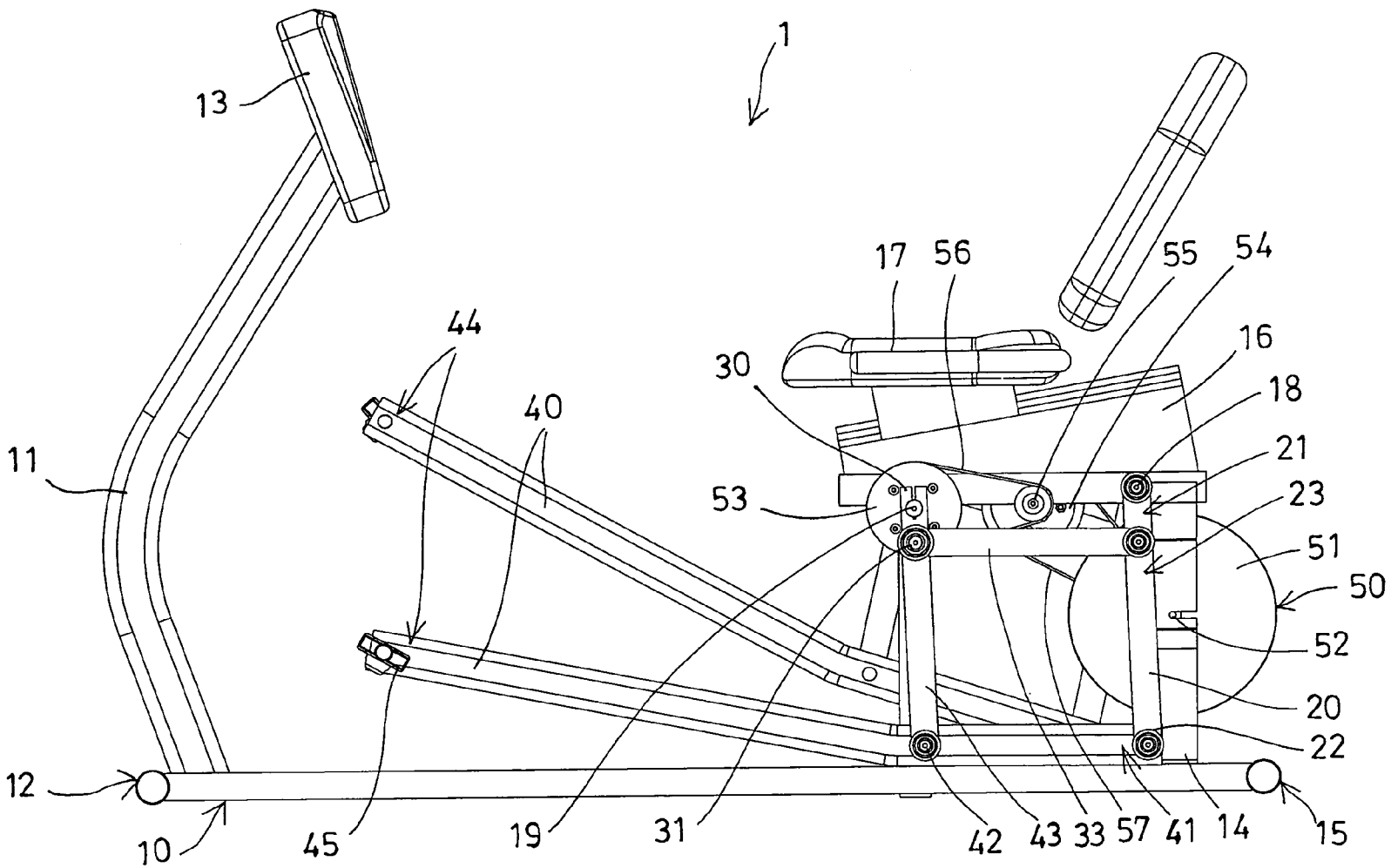
FIG. 3 is a side plan schematic view of the stationary exerciser.
Figure 4:
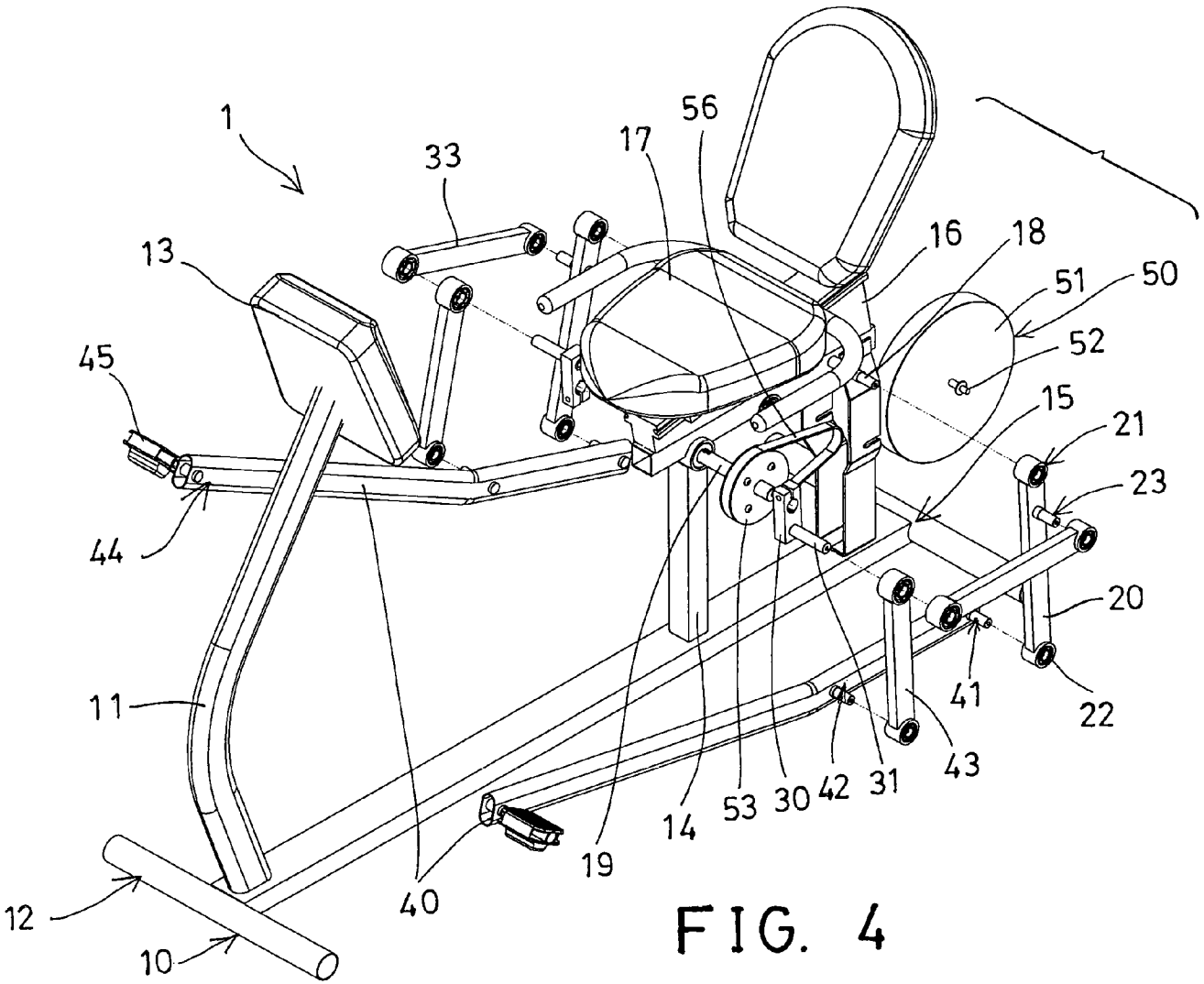
FIG. 4 is a partial exploded view of the stationary exerciser as seen from the front portion of the stationary exerciser.
Figure 5:
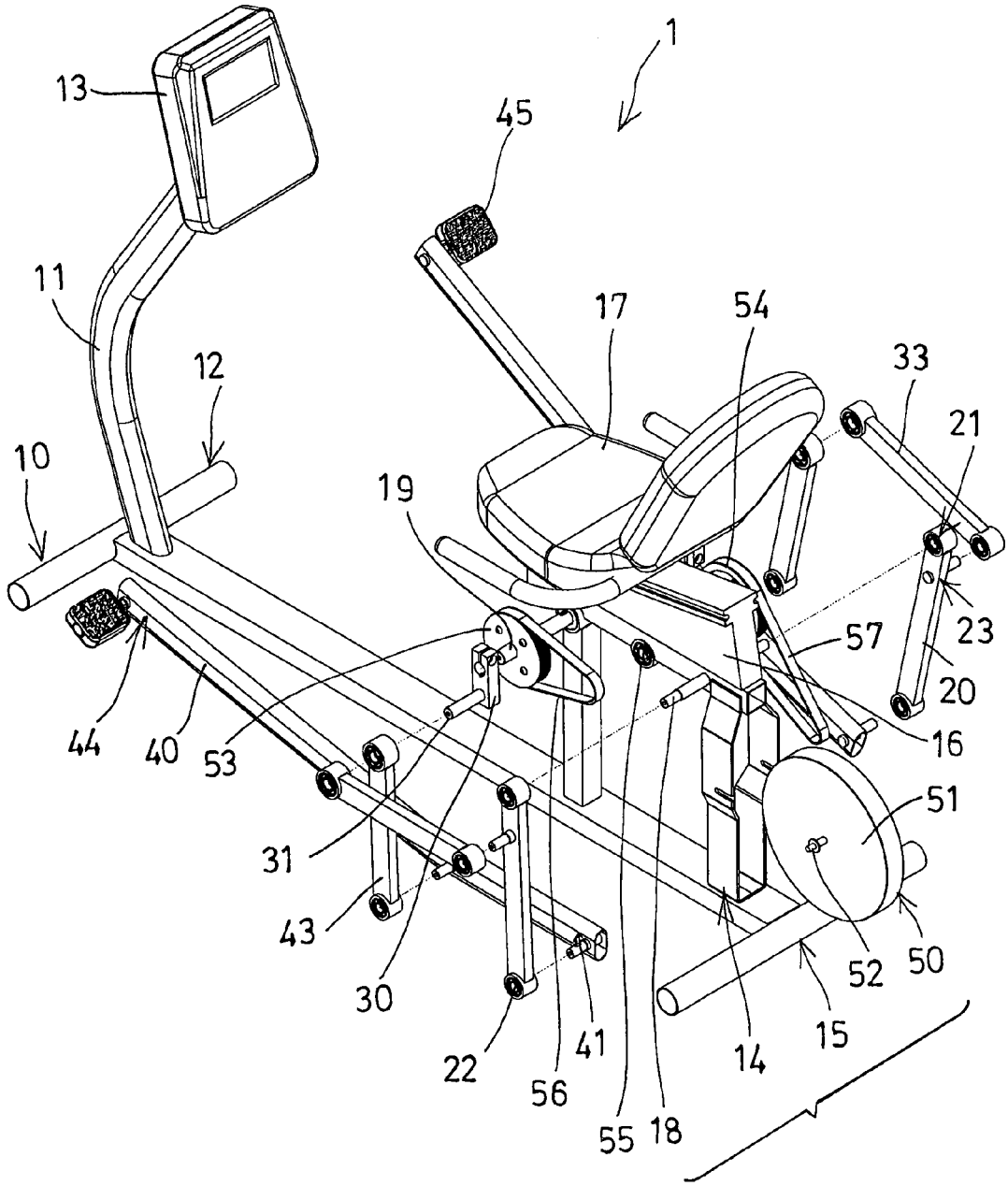
FIG. 5 is another partial exploded view of the stationary exerciser as seen from the rear portion of the stationary exerciser.

A resistive or retarding means or device 50 may further be provided and attached or coupled to the foot supports 40 or to the levers 20 or to the cranks 30 for applying a resistive or retarding force against the foot supports 40 or the levers 20 or the cranks 30 or the spindle 19. For example, the resistive or retarding means or device 50 includes a wheel 51 rotatably attached to the upright support 14 with an axle 52, and a follower or rotary member 53 attached or secured to the spindle 19 and rotated in concert with the spindle 19, and another rotary member or follower 54 rotatably attached to the upright support 14 with a pivot pin 55 (FIGS. 3, 5, 7).

The resistive or retarding means or device 50 further includes a coupling means or device 56 for coupling the spindle 19 or the rotary member 53 to the pivot pin 55 or the follower 54, and another coupling means or device 57 for coupling the pivot pin 55 or the follower 54 to the axle 52 or the wheel 51, or the wheel 51 may be directly coupled to the spindle 19 or the rotary member 53 without through the pivot pin 55 or the follower 54, for applying a resistive or retarding force to the spindle 19 or the rotary member 53 or the foot supports 40 or the levers 20 or the cranks 30. A braking device, such as a magnetic braking device (not shown) may further be provided and attached or coupled the wheel 51 for braking the wheel 51.

It is to be noted that the foot pedals 45 or the foot supports 40 may be stepped or operated or actuated by the feet of the users and may be moved elliptically relative to the base 10 or the upright support 14. In addition, as shown in FIGS. 6 and 7, due to the oval or elliptical moving stroke, the foot pedals 45 or the foot supports 40 may be stepped or actuated or forced by the feet of the users for a longer distance than that for the typical pedaling or cycling exercisers, and no dead centers or points may be occurred for allowing the foot pedals 45 or the foot supports 40 to be suitably operated or actuated by the users.

Accordingly, the stationary exerciser in accordance with the present invention includes a pair of foot supports or foot pedals for being stepped or operated or actuated similar to the pedaling or cycling exercisers, but along an elliptical moving path different from the circular cycling moving path of that of the pedaling or cycling exercisers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stationary exerciser comprising:

a base, an upright support extended upwardly from a rear portion of said base for supporting a seat, a spindle and a shaft attached to said upright support, and said spindle being spaced from said shaft and located in front of said shaft, a pair of levers each including an upper portion pivotally attached to said upright support with said shaft for allowing said levers to swing relative to said upright support, and each including a lower portion, a pair of cranks rotatably attached to said upright support with said spindle for allowing said cranks to be rotated relative to said upright support, said cranks each including a pivot rod attached thereto, a pair of foot supports each including a front portion, and each including a foot pedal attached to said front portion of said foot support, and each including a rear portion pivotally coupled to said lower portion of said lever for allowing said rear portion of said foot support to swing relative to said upright support, and each including a middle portion pivotally coupled to said pivot rod of said crank with a link for allowing said middle portions of said foot supports to be moved cyclically relative to said upright support by said cranks, and for allowing said front portions of said foot supports and said foot pedals to be moved elliptically relative to said upright support, and said foot pedals being stepped by a user for being moved elliptically relative to said upright support.

2. The stationary exerciser as claimed in claim 1, wherein an arm is coupled between said crank and said lever for pivotally coupling said lever and said crank together.

3. The stationary exerciser as claimed in claim 2, wherein said arm is coupled to a middle portion of said lever.

4. The stationary exerciser as claimed in claim 2, wherein said arm is coupled to said pivot rod of said crank.

5. The stationary exerciser as claimed in claim 1 further comprising means for resisting said spindle.

6. The stationary exerciser as claimed in claim 5, wherein said resisting means includes a rotary member attached to said spindle and rotated in concert with said spindle.

7. The stationary exerciser as claimed in claim 6, wherein said resisting means includes a follower rotatably attached to said upright support with a pivot pin and coupled to said rotary member with a coupling device.

8. The stationary exerciser as claimed in claim 7, wherein said resisting means includes a wheel rotatably attached to said upright support with an axle and coupled to said follower with a coupling device.

* * * * *